United States Patent [19]

Beduhn et al.

[11] 4,387,814

[45] Jun. 14, 1983

[54] TRAVELING ATTACHMENT FOR RING SUPPORTED LIFT CRANE

[75] Inventors: Daniel E. Beduhn; James G. Morrow, Sr., both of Manitowoc, Wis.

[73] Assignee: The Manitowoc Company, Inc., Manitowoc, Wis.

[21] Appl. No.: 344,388

[22] Filed: Feb. 1, 1982

Related U.S. Application Data

[63] Continuation-in-part of Ser. No. 300,016, Sep. 8, 1981, which is a continuation of Ser. No. 58,284, Jul. 17, 1979, abandoned, and a continuation-in-part of Ser. No. 305,519, Sep. 25, 1981, which is a continuation-in-part of Ser. No. 58,285, Jul. 17, 1979, abandoned.

[51] Int. Cl.[3] ..... B66C 23/78; B66C 23/73

[52] U.S. Cl. ..... 212/195; 212/189; 280/762; 180/9.46

[58] Field of Search ..... 212/182–183, 212/188–189, 195, 198, 223–224, 232, 237–238, 245, 247–248, 254–255; 280/762–764; 180/9.44, 9.46

[56] References Cited

U.S. PATENT DOCUMENTS

| | | | |
|---|---|---|---|
| 3,747,718 | 7/1973 | Gauchet | 180/9.46 |
| 3,868,022 | 2/1975 | Greenlay et al. | 180/140 |
| 3,878,944 | 4/1975 | Beduhn et al. | 212/189 |
| 3,900,077 | 8/1975 | Gee et al. | 180/9.46 |
| 4,020,952 | 5/1977 | Scodino | 212/189 |
| 4,196,816 | 4/1980 | Dvorsky et al. | 212/195 |

FOREIGN PATENT DOCUMENTS

| | | | |
|---|---|---|---|
| 267134 | 2/1964 | Australia | 212/189 |
| 1436263 | 8/1965 | France | 212/195 |

*Primary Examiner*—Trygve M. Blix
*Assistant Examiner*—R. B. Johnson
*Attorney, Agent, or Firm*—Leydig, Voit, Osann, Mayer & Holt, Ltd.

[57] ABSTRACT

A traveling attachment including two pairs of crawler assemblies and frame elements are provided for interconnection to the ring of a ring supported crane so the crane can travel under load. The crawler assemblies may be pivotally mounted and reversely and independently powered to facilitate turning.

5 Claims, 3 Drawing Figures

TRAVELING ATTACHMENT FOR RING SUPPORTED LIFT CRANE

BACKGROUND OF THE INVENTION

This application is a continuation-in-part of our applications Ser. Nos. 300,016 filed Sept. 8, 1981 and 305,519, filed Sept. 25, 1981, which respectively are a continuation and a continuation-in-part of our applications Ser. Nos. 58,284 now abandoned and 58,285, now abandoned both filed July 17, 1979, and which are incorporated herein by reference.

This invention relates generally to lift cranes and more particularly concerns a traveling attachment for ring supported cranes.

In response to ever-increasing user needs, self-propelled cranes have been made capable of lifting ever greater loads. While a number of factors enter into determining crane capacity, a basic limitation arises from the fact that, inevitably, the weight of the crane and its load must be transferred to the earth in some stable fashion, and, if rotation of the load is desired, the crane-earth connection must be made stable through the arc of crane rotation.

A significant increase in crane capacity was achieved by providing a self-propelled crane with the support ring and extended boom carrier disclosed and claimed in U.S. Pat. Nos. 3,485,383 and 3,878,944, assigned to the assignee of the present invention. In this design, the weight of the crane and its load is transferred to the ground through a large diameter, track-like ring. As shown in these patents, and as practiced commercially for some years, the support ring is either blocked into place by timbers fitted and wedged beneath and completely around the ring or is supported by a plurality of jacks spaced around the periphery of the ring.

SUMMARY AND OBJECTS OF INVENTION

The primary aim of the present invention is to provide an attachment which permits such a ring supported crane to travel under load.

It is also an object of the invention to provide a traveling attachment as characterized above that can rapidly be set up for crane operation so as to increase the mobility of a crane using the track-like ring support.

It is a further object of the present invention to provide two pairs of crawler tracks mounted to and outboard of the ring support with each crawler track being reversely and independently powered.

Other objects and advantages of the invention will become apparent upon reading the following detailed description and upon reference to the drawings, in which:

Figure 1:
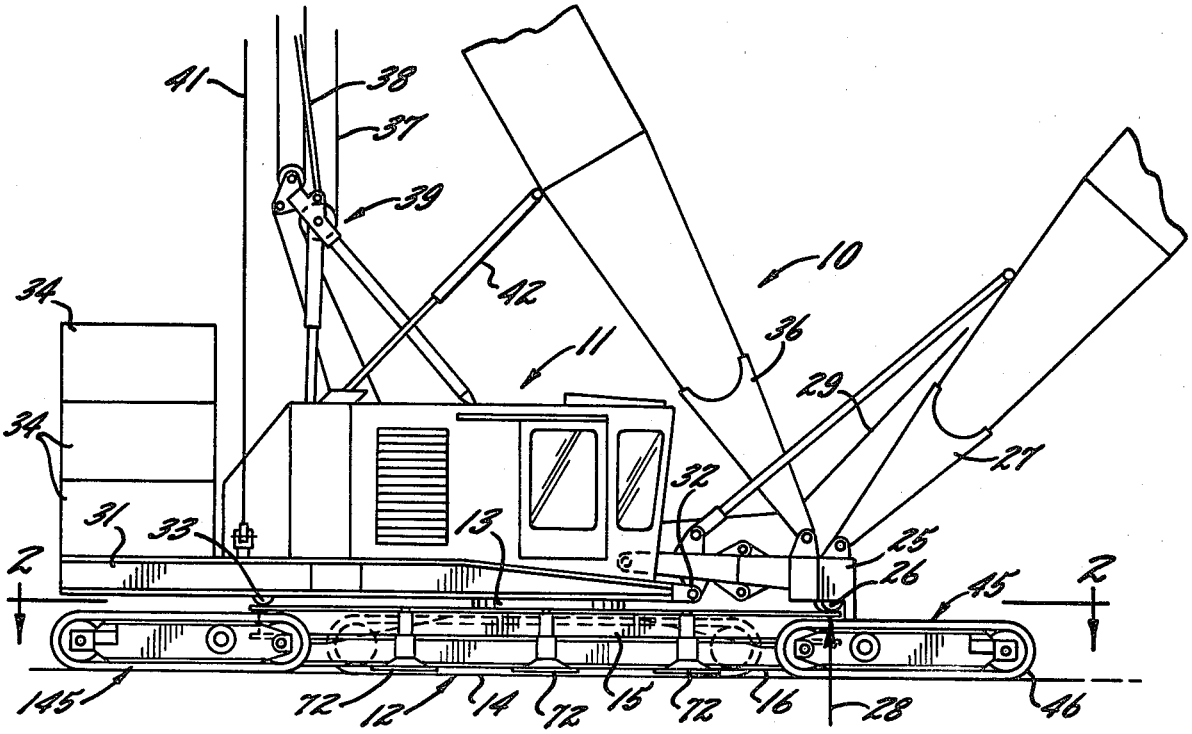
FIG. 1 is a fragmentary elevation of a crane support structure embodying the present invention.

While the invention will be described in connection with a preferred embodiment, it will be understood that we do not intend to limit the invention to that embodiment. On the contrary, we intend to cover all alternatives, modifications and equivalents as may be included within the spirit and scope of the invention as defined by the appended claims.

DESCRIPTION OF PREFERRED EMBODIMENT

Turning to the drawing, there is shown a crane 10 having an upper structure 11 mounted for rotation on a car body 12 through a roller path 13. The crane 10 is normally mobile and, for moving over the ground, crawler assemblies 14 are attached to the car body 12. The lower works of the crane including the car body 12 and crawler assemblies 14 may be demountably assembled as taught in U.S. Pat. No. 4,000,784 and the crawler assemblies may be independently powered as taught in U.S. Pat. No. 4,069,884.

In order to increase the capacity of the crane 10, a track-like ring 15 horizontally surrounds the car body 12 and crawler assemblies 14 and in the illustrated embodiment the ring 15 is secured to the ends of support beams 16 and 17. Preferably, the ring has an I-beam cross section with a hardened upper path surface. To adapt the illustrated crane for this ring support configuration, the support beams 16, 17 are secured to the car body 12 running outboard and parallel to the crawler assemblies 14 so that the beams become part of the car body. It will be understood, of course, that other means may be employed for attaching the ring 15 to the car body 12.

The geometry of the crane 10 contributes to its high capacities when used with the ring support. In the illustrated crane 10 a boom carrier 25 is pivoted for vertical movement on the upper structure 11 and is provided with a roller assembly 26 for rotation on the ring 15. A boom 27 is mounted on the carrier at what becomes the load lifting fulcrum 28 of the system, and a load lift line 29 runs along and over the end of the boom 27. A counterweight carrier 31 is also mounted for vertical movement at 32 on the upper structure 11 and the carrier extends the opposite direction from the boom carrier 25 to ride on the ring 15 through roller assemblies 33, only one of which is shown. One or more counterweights 34 are stacked on the carrier 31.

In effect, all structure to the non-boom side of the fulcrum 28 is available for counterbalancing and stabilizing the crane 10. Preferably, a mast 36 is mounted on the carrier 25 and boom lift rigging 37 interconnects the tops of the mast 36 and the boom 27 for moving the boom vertically. The mast 36 is secured by pendants 38 to gantry structure 39 on the upper structure 11 to form a substantially rigid assembly, and other pendants 41 provide substantially rigid connections between the counterweight carrier 31 and the top of the mast 36. Struts 42 in the form of most stops establish the substantially fixed angular position of the mast 36. This geometry creates a stable, high capacity crane.

In accordance with the present invention, a front traveling support attachment 45 is provided at the front of the ring 15 for supporting the ring 15 under the fulcrum 28. Likewise, a rear traveling support attachment 145 is provided at the rear of the ring 15 for supporting the rear of the ring under the counterweight carrier 31. The two traveling support attachments 45 and 145 permit movement of the crane 10 and ring 15 over the ground while the boom 27 is lifting a heavy load.

In the preferred embodiment, the front traveling support attachment 45 includes a pair of laterally spaced crawler assemblies 46 and 47 respectively located adjacent the forward ends of the support beams 16 and 17. The crawler assemblies 46, 47 are connected together by a frame element 48 which, in turn, is interconnected from adjacent its ends to the car body 12 by a pair of frame elements 51 and 52 on which the ring 15 is supported. Preferably, the frame elements 51, 52 are pin connected to the car body 12 and project forwardly in diverging relation between the lateral support beams 16, 17 where they are connected to the frame element 48.

Likewise, the rear traveling support attachment 145 includes a pair of laterally spaced crawler assemblies 146 and 147 respectively located adjacent the rear ends of the support beams 16 and 17. The crawler assemblies 146, 147 are connected together by a frame element 148 which, in turn, is interconnected from adjacent its ends to the car body 12 by a pair of frame elements 151 and 152 on which the ring 15 is supported. Preferably, the frame elements 151, 152 are pin connected to the car body 12 and project rearwardly in diverging relation between the lateral support beams 16, 17 where they are connected to the frame element 148.

When a heavy load is lifted by the boom 27, the forces are transmitted down through the boom 27 and mast 36 to the boom carrier 25 riding on the ring 15 adjacent the fulcrum 28. The lifting forces are also transmitted through pendants 41 to the counterweights 34 stacked on the carrier 31 tending to lift the carrier 31 off the ring 15. Since the attachment frame elements 51, 52 support the ring 15 adjacent the fulcrum 28, the lifting forces pass primarily down through the ring 15 to the attachment assembly and are resisted by the crawler assemblies 46, 47 engaging the ground. If it is desired to travel with a load, power may be applied to the main crawler assemblies 14 and the crane 10 and ring 15 may be "walked" ahead with the load being primarily supported by the traveling support attachment 45 and its crawler assemblies 46, 47. Of course, the crane 10 may also be traveled rearwardly under load by reversing the direction of movement of the main crawlers 14. In each case the crawler assemblies 46, 47, 146 and 147 are normally not powered but simply "free wheel."

In keeping with a further aspect of the invention, the crawler assemblies 46, 47, 146 and 147 are preferably pivotally mounted to end portions 53, 54, 153 and 154 of the frames 48 and 148 by yoke elements 55, 56, 155 and 156 and vertical pivot posts 57, 58, 157 and 158, respectively. Additionally, hydraulic cylinders 61, 62, 161 and 162 are provided interconnecting the frame end portions 53, 54, 153 and 154 and the crawler assemblies 46, 47, 146 and 147 to permit turning the crawler assemblies 46, 47, 146 and 147 and thus facilitate moving the crane 10 under load about a curved path.

While the crawler assemblies 46, 47, 146 and 147 need not be independently powered for most applications, the mobility and maneuverability of the crane 10 traveling under load may be further enhanced by selectively and reversibly powering the crawlers 46, 47, 146 and 147 such as by independent hydraulic motors 65, 66, 165 and 166, respectively. Operation of motors 65 and 66 increases the traction power of the crane 10, since the load is primarily supported on the crawlers 46 and 47. In addition operation of all four motors 65, 66, 165 and 166, insures more positive steering control when the crane is moved in a curved path.

The rear traveling support attachment 145 in addition to assisting with traction and steering supports the counterweight carrier 31 to resist rearward tipping of the crane 10 and ring 15 when a heavy load is not being supported by the boom 27. This avoids the necessity of removing portions of the counterweight 34 from the carrier between successive heavy lift operations.

It should also be appreciated that the front traveling support attachment 45 and/or the rear traveling support attachment 145 may be quickly and conveniently attached and detached from a standard ring supported crane such as disclosed in U.S. Pat. No. 3,878,944 which is incorporated herein by reference. As shown in that patent, a plurality of ring support arms 71 are pivoted for vertical movement on the car body 12 and extend outwardly to underlie the ring 15 at spaced points around the ring periphery. A plurality of jacks 72 (either manual or hydraulic) are positioned one at the end of each of the arms 71 with the jacks 72 being sized so as to engage the ground when extended and lift the ring 15, the car body 12 and the crawler assemblies 14 from the ground.

To facilitate setting up the ring 15, four hydraulic jacks 73, 74, 173 and 174 are mounted near each end of frames 48 and 148 of the traveling support attachments 45 and 145. Manipulation of these jacks allows the ring 15 to be lifted and leveled, whereupon the manual jacks 72 can be quickly extended to provide firm support for the ring completely around its periphery and to facilitate coupling and uncoupling the traveling support attachments 45 and/or 145.

If it is desired to move a heavy load from a forward position to a lateral position, or vice-versa, the jacks 73, 74, 173 and 174 attached to the beams 48 and 148 may be energized and the crawler assemblies 46, 47, 146 and 147 may be turned in to positions substantially tangential to the ring 15. This permits the entire ring-crane assembly to "walk" around its own center.

Figure 3:
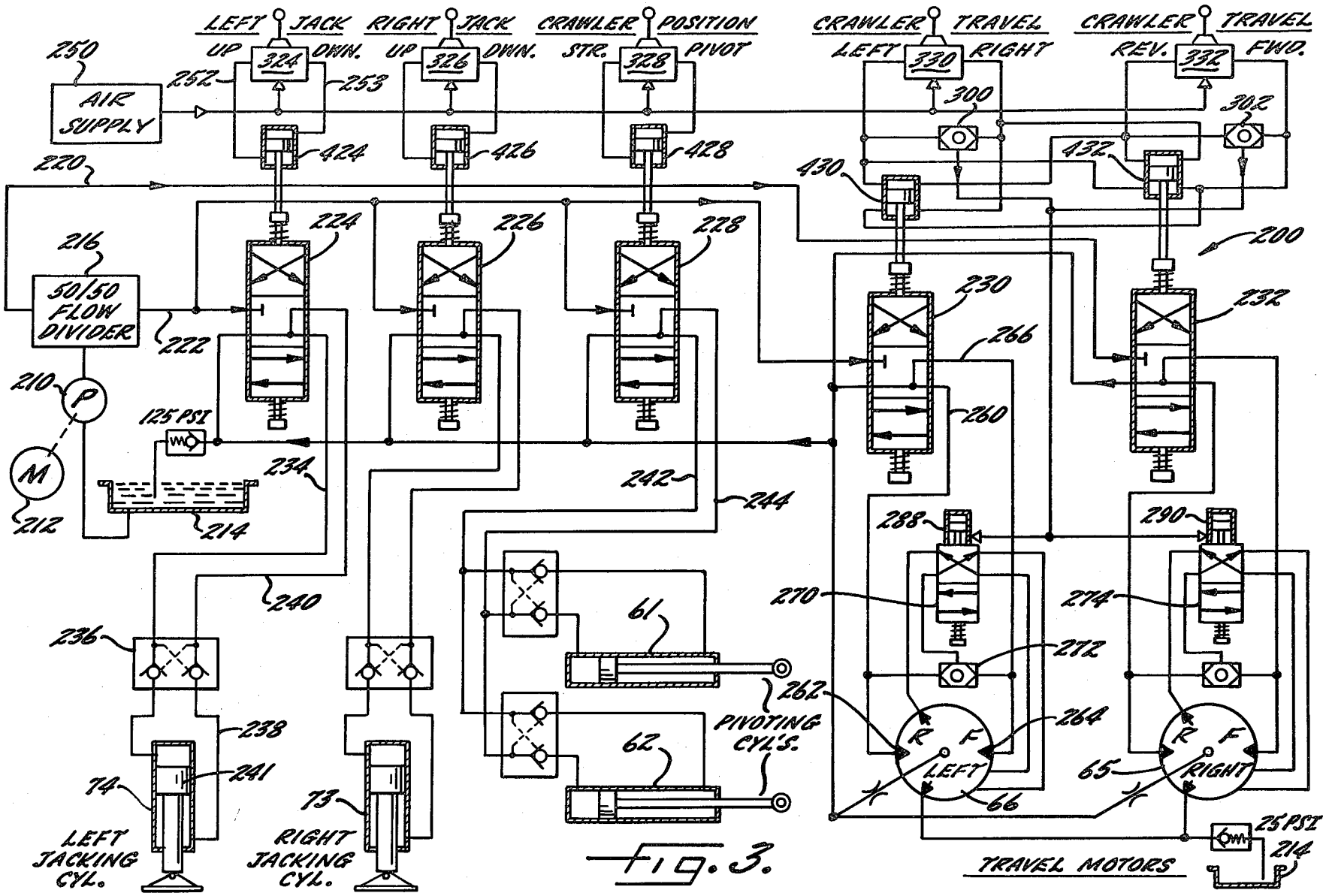
FIG. 3 is a schematic diagram of the hydraulic control and drive system for the traveling attachment.

In order to control and to drive the crawlers 46, 47, 146 and 147, a hydraulic control system 200 is provided and shown schematically in FIG. 3. FIG. 3 shows only the hydraulic control system for the front crawler assemblies 46 and 47. It should be understood that an identical hydraulic control system would be provided for the rear crawler assemblies 146 and 147. In order to appreciate the operation of the hydraulic control system 200, a description of the cranes traveling operation is useful.

For travel under load either in a straight line or in a circle, the boom is first rotated on the ring 15 so that its lifting fulcrum 28 is centered over either the front or rear traveling support attachments 45 or 145. (The following description will be concerned only with the illustrative situation in which the lifting fulcrum 28 of the boom is supported by the front traveling attachment 45.) After centering the lifting fulcrum, jacks 73, 74, 173 and 174 lift the ring 15 so that the manual jacks 72 can be retracted and the load lowered onto the main crawler assemblies 14 and the traveling support attachment crawler assemblies 46, 47, 146 and 147.

For straight line travel the hydraulic control system allows motors 65, 66, 165 and 166 to free wheel and the propulsion is provided by the main crawlers 14. If additional traction is needed, the traveling support attachment crawlers 46, 47, 146 and 147 can be powered by providing hydraulic drive to motors 65, 66, 165 and 166. In that circumstance the hydraulic drive to motors 65, 66, 165 and 166 must be controlled so that if one crawler loses traction and spins it does not rob the other crawlers of hydraulic drive.

Figure 2:
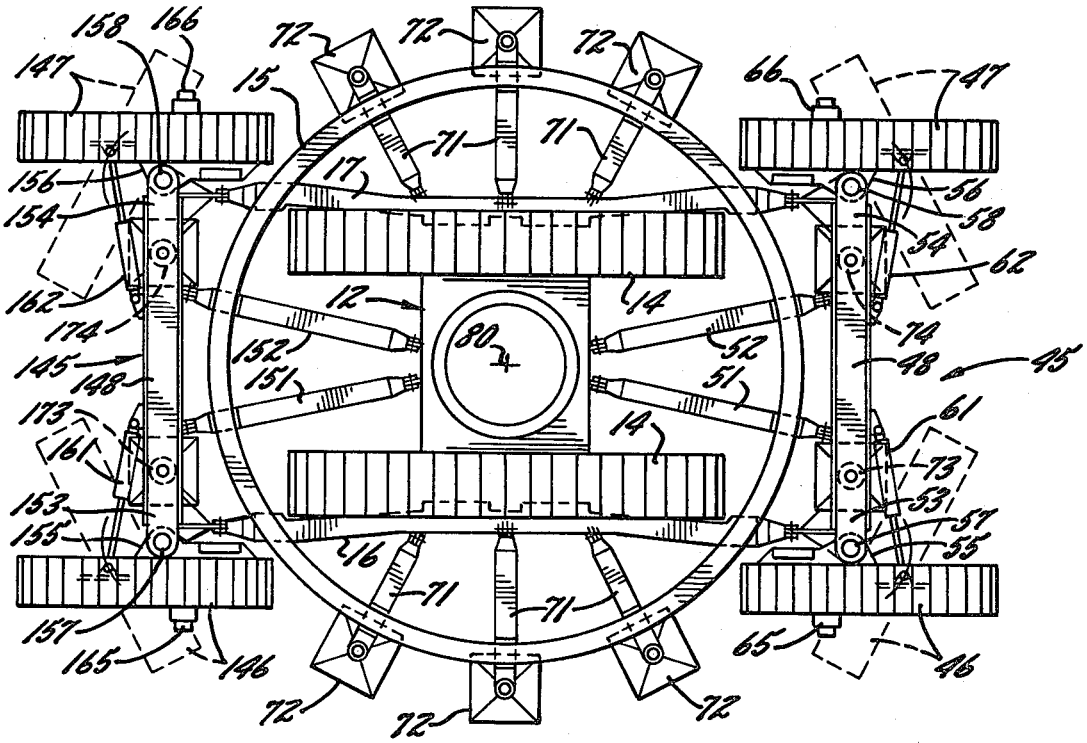
FIG. 2 is a section taken approximately along the line 2—2 in FIG. 1.

For rotational travel, the crawlers 46, 47, 146 and 147 are rotated by means of hydraulic cylinders 61, 62, 161 and 162 to positions such that their driving directions are tangential to the ring 15 (shown in phantom in FIG. 2). The whole crane can then be rotated about its center axis 80 by driving crawlers 46, 47, 146 and 147 by means of hydraulic motors 65, 66, 165 and 166.

As shown in FIG. 3, the hydraulic control system 200 controls the operation of front crawler assemblies 46 and 47 (again keeping in mind that an identical hydraulic control system would be provided for controlling rear crawlers 146 and 147). The hydraulic control system 200 controls the operation of jacking cylinders 73 and 74 which in conjunction with jacking cylinders 173 and 174, are used to raise the ring for engaging and disengaging the peripheral jacks 72. In addition the hydraulic control system 200 also controls hydraulic motors 65 and 66 by providing selective forward and reverse drive. And finally the hydraulic control system 200 controls pivoting cylinders 61 and 62 to move the crawlers 46 and 47 into alignment for either tangential movement or straight ahead movement.

In order to provide the required hydraulic control, the hydraulic control system 200, has a fixed displacement pump 210 which is driven by the crane's main motor 212. A reservoir 214 of hydraulic fluid is provided for supplying hydraulic fluid to the input of pump 210. The output of pump 210 is connected to a 50/50 flow divider 216 which provides half of the pump's flow to one main feed line 220 and the other half of the pump's flow to another main feed line 222. The hydraulic line 222 is connected to the center tap inputs of left jack control valve 224, right jack control valve 226, crawler position control valve 228 and left hydraulic motor control valve 230. The other hydraulic line 220 is connected to the center tap of right hydraulic motor control valve 232.

Each of the hydraulic control valves 224, 226, 228, 230 and 232 are conventional three position spool valves that are biased to their center "off" position. When the spool is moved upward (as viewed in FIG. 3), the control valve allows pressurized hydraulic fluid to flow from the center tap to the hydraulic motor or cylinder in the forward direction and back through the control valves to the reservoir. When the spool is moved downward (as viewed in FIG. 3), the flow of the hydraulic fluid is reversed and the operation of the cylinders or motors are reversed. The operation of the spools of the hydraulic control valves 224, 226, 228, 230 and 232 is provided by air cylinders 424, 426, 428, 430 and 432 respectively. The air cylinders 424, 426 and 428 are in turn controlled by manually operated pneumatic controls 324, 326 and 328 respectively, and air cylinders 430 and 432 are controlled either by pneumatic control 330 or 332.

Specifically, when the left jack pneumatic control 324 is manually pushed to its "up" position, pressurized air from air supply 250 is connected to air line 252 which serves to retract air cylinder 424 thus moving the spool of the control valve 224 upward. When the spool of the hydraulic control valve 224 is moved upward, pressurized hydraulic fluid in line 222 is fed to output line 240, through cross check valve 236 to retract the left jacking cylinder 74. As the left jacking cylinder 74 retracts, hydraulic fluid above the piston 241 is forced back through line 234, through the control valve 224, to the reservoir.

Alternatively when the left jack pneumatic control 324 is manually moved to its "down" position, pressurized air in line 253 extends air cylinder 424 to move the spool of hydraulic control valve 224 downward thus reversing the hydraulic flow to jacking cylinder 74 and causing it to extend. The right jacking cylinder 73, with its associated hydraulic control valve 226 and its pneumatic control valve 326 works in a similar fashion.

The pivoting cylinders 61 and 62, which control the position of the crawlers 46 and 47 respectively, are controlled simultaneously by hydraulic control valve 228, air cylinder 428 and pneumatic control 328. Specifically, when the pneumatic control 328 is moved to its "Str" (straight) position, air cylinder 428 retracts, and pressurized hydraulic fluid is connected by control valve 228 to line 244 to extend both pivoting cylinders 61 and 62. When the pivoting cylinders 61 and 62 are extended, the crawlers 46 and 47 are positioned as shown in solid lines in FIG. 2.

Alternatively, the crawlers 46 and 47 may be pivoted to their phantom line positions (FIG. 2) by moving pneumatic control 328 to its "pivot" position and retracting pivoting cylinders 61 and 62.

The crawler hydraulic motors 65 and 66 are controlled by right crawler control valve 232 and left crawler control valve 230, respectively. The right crawler control valve 232 is supplied with pressurized hydraulic fluid by line 220 while the left hydraulic control valve 230 is supplied with pressurized hydraulic fluid from line 222. Providing the two hydraulic crawler motor control valves 232 and 230 from separate sources of hydraulic fluid assures that each will provide the hydraulic motor it drives and controls with a substantially constant supply of pressurized hydraulic fluid during crawler operation. The reason for this is to assure that if one crawler loses traction it does not spin and siphon off all of the pressurized hydraulic fluid from the crawler that still has traction. Thus the independent supplies of hydraulic fluid for each crawler motor 65 and 66 assures that the crawlers operate so that the crawler that has traction has driving fluid to assure its continuing rotation.

The hydraulic motor control valves 232 and 230 essentially provide the forward and reverse drive to the hydraulic motors 65 and 66. Turning first to the left crawler motor 66, and its associated control valve 230, it can be seen that when the spool of the hydraulic control valve 230 is pushed down by the action of air cylinder 430, the pressurized hydraulic fluid in line 220 is fed to line 260 which is connected to the reverse port 262 of the hydraulic motor 66 to drive the motor in its reverse direction. The pressurized hydraulic fluid supplied to port 262 of the hydraulic motor returns to the reservoir 214 from the motor via forward port 264, through line 266 and through the motor control valve 230. Alternatively, when the spool of the left crawler motor control valve 230 is moved upward, the pressurized hydraulic fluid is fed to line 260 and thus to the forward port 264 of the hydraulic motor 266, in order to drive it in its forward direction.

The hydraulic motor 66 is preferably a variable displacement motor which possesses the capability of being either "in activated mode" or "in neutral" for free wheeling. In order to control the engagement of the variable displacement motor 66, a dual action motor control valve 270 is provided and is spring biased to the position shown (spool down). Pressurized hydraulic fluid is provided to control valve 270 by means of a two-way shuttle valve 272 which has its inputs connected to lines 260 and 266. As a result, at any time the control valve 230 is in either of its driving positions (up or down), pressurized hydraulic fluid is provided through shuttle valve 272 to the motor control valve 270. When the motor control valve 270 is in its normal position (shown with the spool of the valve being down), the hydraulic motor 66 is "in neutral" or free wheeling. As a result, when the main crawler 14 is powered, the crawlers 46 and 47 simply act as free wheeling idlers.

The hydraulic motor 65 is operated by its control valve 232 and its motor control valve 274 in a similar manner.

The control valves 232 and 230 as well as the motor control valves 270 and 274 are activated by pneumatic controls 330 and 332. Pneumatic control 330 controls the crawler's drive when the crawlers 46 and 47 are in their pivoted position, and pneumatic control 332 controls the crawler's drive when the crawlers 46 and 47 are in their straight position.

Pneumatic control 330 is connected to the air supply 250 to provide pressurized air to air cylinders 430 and 432, which air cylinders control the spools of control valves 230 and 232, respectively. In addition, pneumatic control valve 330 provides pressurized air via two-way shuttle valve 300 to cylinders 288 and 290 of the motor control valves 270 and 274 respectively, to "shift" the hydraulic motors into activated mode when pressurized hydraulic fluid is provided by the control valves 230 and 232.

Pneumatic control 330 is connected so as to provide pressurized air to the opposite sides of the cylinders 284 and 286. When the pneumatic control 330 is in its "left" position, pressurized air is supplied to the top of the cylinder 430 and to the bottom of cylinder 432. As a result, the hydraulic control valve 230 is in its reverse position (down) so that the motor 66 runs in reverse and the control valve 232 is in its forward position (up) so that the hydraulic motor 65 runs in its forward direction. Looking then at FIG. 2, and with the crawlers 46 and 47 in their pivoted, phantom line positions, one can see that with motor 66 running in reverse, and motor 65 running in its forward direction, the crane will be pivoted counterclockwise (to the left).

Alternatively, when the pneumatic control valve 330 is in its "right" position the motors 65 and 66 are reversed in their operation and the crane pivots to the right.

Another pneumatic control 332 provides for forward and reverse power for the crawlers 46 and 47 when they are in their straight line positions shown in FIG. 2. When the pneumatic control 332 is put in its "reverse" position, pressurized air is fed to the top portion of both air cylinders 430 and 432 so as to push the spools of control valves 230 and 232 downward and provide pressurized hydraulic fluid to the reverse ports of both hydraulic motors. Simultaneously pressurized air is connected to air cylinders 288 and 290 via two-way shuttle valve 302 to shift the hydraulic motors 65 and 66 into activated mode.

Alternatively, when the control lever of pneumatic control 332 is in the forward position, both control valves 230 and 232 are shifted into their forward position (up) to provide forward drive for the hydraulic motors. Again, shuttle valve 302 is provided to control the gear control valves 270 and 274 so that as soon as the pneumatic control 332 is providing pressurized air at its outputs, the hydraulic motors are shifted from neutral into activated mode.

The utility of the invention can best be understood by reference to the various modes of operation of the traveling crane. Initially the crane is on its jacks 72 and has lifted a heavy load in anticipation of moving the load either forward or backward in a straight line (i.e., the pivoting cylinders 61, 62, 161, and 162 are extended). First, both the left and right jacking cylinders are extended by moving the control lever on pneumatic controls 324 and 326 to the down position. After the jack cylinders 73 and 74 (and 173 and 174) have been extended, the manual jacks 72 are retracted. After the manual jacks 72 have been retracted, the hydraulic jacks 73, 74, 173 and 174 are likewise retracted by putting the left and right pneumatic controls 324 and 326 in their up position. (At the same time, the identical pneumatic controls for the rear power assemblies would also be retracted.) Once the jacking cylinders 73, 74, 173 and 174 have been retracted, the weight of the crane and its load rests on the crawler assemblies 45 and 145 as well as on the main crawler assemblies 14. In order to move the crane forward or backward in a straight line, the operator would then simply provide forward or reverse power to the main crawlers 14 of the crane. The crawlers 46, 47, 146 and 147 would be in their neutral position so that they would simply free wheel as the crane is moved by the main crawler assemblies 14.

If additional traction is needed, the operator would then move the pneumatic control 332 to its forward position to shift the crawlers motors 65 and 66 into activated mode and at the same time provide, by means of control valves 230 and 232, forward driving hydraulic fluid to both hydraulic motors 65 and 66. Again because each control valve 230 and 232 is fed by an independent constant source of hydraulic fluid, each drive motor 65 and 66 is independently powered so that if one loses traction the other is not starved for driving fluid.

If the operator desires to turn the crane, the ring 15 is jacked up by means of jacking cylinders 73, 74, 173 and 174. Once the crane has been jacked up, the pivoting cylinders 61, 62, 161 and 162 are retracted by moving the pneumatic control 328 to its "pivot" position. With the pivoting cylinders 61, 62, 161 and 162 retracted, each of the crawler assemblies 46, 47, 146 and 147 are aligned tangential to the ring 15.

After the crawlers have been moved into their tangential positions, the crane is lowered by retracting jacking cylinders 73, 74, 173 and 174. If the operator desires to rotate the crane to the left (counterclockwise), he moves the pneumatic control valve 330 to its "left" position to provide pressurized air to the top of air cylinder 430 and the bottom of air cylinder 432. As a result, control valve 230 is moved to its reverse position and control valve 232 is in its forward position so that the hydraulic motor 66 operates in reverse and the hydraulic motor 65 operates in its forward direction. Likewise, motor 166 operates in its reverse direction and motor 165 operates in its forward direction so that the crane pivots around its center point 80. By moving the pneumatic control 330 to its "right" position, the hydraulic motors are reversed, and the crane rotates to the right (clockwise). Again, the independent supply of hydraulic fluid to each of the control valves 230 and 232 assures that the crawler that has traction has sufficient hydraulic driving fluid to continue to rotate.

From the foregoing it will be seen that the present invention provides a highly versatile heavy lift crane that can either "walk" or turn about its own center while lifting a very heavy load.

We claim as our invention:

1. In a crane having an upper structure mounted for rotation on a lower carbody including crawler means for moving the crane over the ground, the combination comprising, at least a pair of support beams secured to said lower carbody, a track-like ring secured to said beams and horizontally surrounding said lower carbody and said crawler means, said beams extending fore and aft beneath and beyond the periphery of said ring, a boom carrier pivoted for vertical movement on said upper structure and riding for rotation on said ring, a boom mounted on said boom carrier for lifting a load, a counter-weight carrier mounted for vertical movement on said upper structure and riding for rotation on said ring, means interconnecting said counterweight carrier and said boom for counteracting a heavy load, a first traveling support attachment including a pair of laterally spaced crawler assemblies respectively attached outboard of said ring adjacent the forward ends of said pair of beams by means including a cross frame interconnecting said crawler assemblies and a plurality of frame elements interconnecting said crawler assemblies and said lower carbody for supporting said ring; a second traveling support attachment including a pair of laterally spaced crawler assemblies respectively attached outboard of said ring adjacent the rearward ends of said pair of beams and means including a cross frame interconnecting said crawler assemblies and a plurality of frame elements interconnecting said crawler assemblies and said lower carbody for supporting said ring; said crawler assemblied of said first and second travelling support attachments being connected to said frame elements through vertical pivot posts with means being provided for pivoting said crawler assemblies about the axes of said posts; and said cross frame including jack means mounted thereon to permit movement of said crane and ring over the ground while said boom is lifting a heavy load.

2. The combination of claim 1 wherein said crawler assemblies each include an endless track and hydraulic motor means are provided for selectively and reversibly driving said tracks.

3. The combination of claim 2, wherein said hydraulic motor means are each driven from an independent source of pressurized hydraulic fluid.

4. The combination of claim 2 including controls for driving both of said crawlers of at least one of said traveling attachments in the same direction.

5. The combination of claim 3 including controls for driving said crawlers of at least one of said traveling attachments in opposite directions.

* * * * *